US010235853B2

(12) United States Patent
Kurella et al.

(10) Patent No.: US 10,235,853 B2
(45) Date of Patent: Mar. 19, 2019

(54) INTERFACE METHOD AND APPARATUS FOR ALARMS

(71) Applicant: General Electric Company, Schenectady, NY (US)

(72) Inventors: Nagesh Kurella, Hyderabad (IN); Abhik Banerjee, Hyderabad (IN); Ayush Srivastava, Hyderabad (IN); Siva S. Gundeboina, Hyderabad (IN); Venkata Ramana Vakulabharanam, Hyderabad (IN); Joseph Kenny, Foxboro, MA (US)

(73) Assignee: General Electric Company, Schenectady, NY (US)

( * ) Notice: Subject to any disclaimer, the term of this patent is extended or adjusted under 35 U.S.C. 154(b) by 106 days.

(21) Appl. No.: 15/387,983

(22) Filed: Dec. 22, 2016

(65) Prior Publication Data

US 2017/0364236 A1 Dec. 21, 2017

(30) Foreign Application Priority Data

Jun. 20, 2016 (IN) ..... 201641021048

(51) Int. Cl.
*G08B 13/196* (2006.01)
*G08B 5/22* (2006.01)

(52) U.S. Cl.
CPC ..... *G08B 13/19682* (2013.01); *G08B 5/22* (2013.01)

(58) Field of Classification Search
CPC combination set(s) only.
See application file for complete search history.

(56) References Cited

U.S. PATENT DOCUMENTS 6,643,555 B1 11/2003 Eller
6,774,786 B1 * 8/2004 Havekost ..... G05B 23/0272 340/500
6,799,080 B1 9/2004 Hylden
7,092,771 B2 8/2006 Retlich
7,551,072 B2 6/2009 Tambascio
7,590,970 B2 9/2009 Bromley
8,659,415 B2 2/2014 Nagathil
8,798,775 B2 8/2014 Plache
(Continued)

OTHER PUBLICATIONS

Ahmad, B., et al., "Automatic Generation of Human Machine Interface Screens from Component-Based Reconfigurable Virtual Manufacturing Cell." Industrial Electronics Society, IECON 2013—39th Annual Conference of the IEEE, Nov. 2013, pp. 7428-7433.
(Continued)

*Primary Examiner* — Hien L Duong
(74) *Attorney, Agent, or Firm* — Fitch, Even, Tabin & Flannery LLP

(57) ABSTRACT

One or more industrial machines is selected from a navigation screen. The selected one or more industrial machines represents a context. A database is accessed and a visualization related to the one or more industrial machines and associated with the context is retrieved. Alarm data related to one or more alarms associated with the one or more industrial machines is received. The visualization is dynamically rendered to a user on a graphical display unit such that the alarm data is selectively displayed within the visualization and in a single view to the user.

16 Claims, 7 Drawing Sheets

(56) References Cited

U.S. PATENT DOCUMENTS 9,046,886 B2* 6/2015 Chong ..... G05B 19/4185
9,983,575 B2* 5/2018 Nixon ..... G05B 23/0267
2002/0163427 A1* 11/2002 Eryurek ..... G05B 23/027 340/500
2004/0260408 A1* 12/2004 Scott ..... G05B 23/0213 700/20
2007/0276514 A1 11/2007 Martinez
2008/0079558 A1* 4/2008 Dorgelo ..... G05B 19/406 340/506
2008/0189638 A1* 8/2008 Mody ..... G05B 19/0426 715/771
2008/0255681 A1* 10/2008 Scott ..... G05B 23/0216 700/12
2009/0089225 A1* 4/2009 Baier ..... G06Q 10/06 706/12
2009/0089682 A1* 4/2009 Baier ..... G06Q 10/10 715/751
2009/0089701 A1* 4/2009 Baier ..... G05B 19/0426 715/772
2009/0089709 A1* 4/2009 Baier ..... G05B 19/409 715/817
2010/0198372 A1 8/2010 Mehta
2011/0001812 A1 1/2011 Kang
2011/0242111 A1* 10/2011 Cupitt ..... G06T 11/003 345/470
2014/0039833 A1* 2/2014 Sharpe, Jr. ..... G05B 23/0229 702/183
2014/0277619 A1* 9/2014 Nixon ..... G05B 15/02 700/83
2014/0277620 A1* 9/2014 Nixon ..... G05B 23/0216 700/83
2014/0282195 A1* 9/2014 Nixon ..... G05B 23/0216 715/771
2014/0303754 A1* 10/2014 Nixon ..... G05B 23/0267 700/83
2014/0310605 A1* 10/2014 Basile ..... H04L 41/22 715/736
2014/0364969 A1* 12/2014 Timsjo ..... G05B 23/0272 700/83
2015/0058808 A1* 2/2015 John ..... G06F 3/04842 715/835
2015/0100893 A1 4/2015 Cronin
2015/0169190 A1* 6/2015 Girardeau ..... G06F 3/04842 715/771
2016/0042541 A1* 2/2016 Nixon ..... G05B 23/0216 715/771
2016/0300475 A1* 10/2016 Childs ..... G08B 25/00
2017/0192628 A1* 7/2017 O'Connor ..... G05B 19/41885
2017/0207926 A1* 7/2017 Gil ..... G06Q 10/20
2017/0321923 A1* 11/2017 Wiens-Kind ..... G08B 27/00
2017/0336930 A1* 11/2017 Tappan ..... G06F 3/0482

OTHER PUBLICATIONS

Ahmed, M.M., et al., "Supervisory Control and Data Acquisition System (SCADA) Based Customized Remote Terminal Unit (RTU) for Distribution Automation System." Power and Energy Conference, 2008. IEEE, pp. 1655-1660.

* cited by examiner

INTERFACE METHOD AND APPARATUS FOR ALARMS

CROSS REFERENCE TO RELATED APPLICATION

This application claims priority from India Application Number IN 201641021048, filed Jun. 20, 2016, which is hereby incorporated by reference.

BACKGROUND

Technical Field

The subject matter disclosed herein generally relates to presenting information to a user. More specifically, the subject matter relates to dynamically presenting information associated with industrial machines to users on human machine interfaces (HMIs), including alarms.

Brief Description of the Related Art

In industrial operations, industrial machines and systems are monitored to ensure proper operation and/or detect anomalies which may arise. Users want to monitor these systems and use human machine interfaces (HMIs) to do so. In one example, an HMI uses a screen on a computer along with the software to display various types of information on the screen. The HMI may also include keyboards or any other mechanism for a human user to enter information.

In some examples, Supervisory Control and Data Acquisition (SCADA) processes and systems are used for remote monitoring and control of industrial control systems and individual components within the industrial control machines and systems. For instance, SCADA systems may be used to operate various types of hardware such as programmable logic controllers (PLCs) within these control systems. The control system itself is designed to operate with the remote equipment (PLCs) by using communication protocols for data acquisition. SCADA systems are typically large-scale in geographic coverage and include several sites that may span different geographical regions.

Historian processes typically utilize software that can obtain or accumulate data obtained by the SCADA systems and store the data in the database. Additionally, events and alarms in a database may be presented as trends displayed at the HMI.

Machines may generate alarms when certain parameters, for example, exceed a threshold. For instance, an alarm may be generated when a pressure or a temperature exceed a certain value. Unfortunately, alarms were generally presented in an inconvenient way to users, for example, on different screens making it difficult for the user to associate the alarm with physical devices or with other aspects of system operation.

The above-mentioned problems have resulted in some user dissatisfaction with previous approaches.

BRIEF DESCRIPTION OF THE DISCLOSURE

The approaches described herein provide approaches for rendering context-based alarm displays along with HMI screens to users. The approaches are easy to implement and provide increased satisfaction for users.

In many of these embodiments, one or more industrial machines is selected from a navigation screen. The selected one or more industrial machines represents a context. A database is accessed and a visualization related to the one or more industrial machines and associated with the context is retrieved. Alarm data related to one or more alarms associated with the one or more industrial machines is received. The visualization is dynamically rendered to a user on a graphical display unit such that the alarm data is selectively displayed within the visualization and in a single view to the user.

In aspects, the alarm data is dynamically updated with new alarm data. In other examples, the alarm data is displayed on the screen as one or more icons and the icons can be selected by the user.

In still other aspects, the selection of an icon by the user is effective to display one or more other alarms associated with a single industrial machine. In other examples, the selection of an icon by the user is effective to display text that indicates an action to take.

In other examples, the alarm with the highest priority is determined, and the icon associated with this alarm is graphically highlighted. In other examples, the one or more icons on the screen are displayed in relationship to the area of the equipment where an alarm is being generated. In other examples, the navigation screen comprises a model or navigation tree.

In others of these embodiments, an apparatus includes a graphical display unit and a processor. The processor is coupled to the graphical display unit. A user selects one or more industrial machines from a navigation screen on the graphical display unit. The selected one or more industrial machines represent a context. The processor is configured to retrieve a visualization related to the one or more industrial machines and associated with the context. The visualization also includes alarm data related to one or more alarms associated with the one or more industrial machines. The processor is configured to dynamically render the visualization to the user on a graphical display unit such that the alarm data is selectively displayed within the visualization and in a single view to the user.

BRIEF DESCRIPTION OF THE DRAWINGS

For a more complete understanding of the disclosure, reference should be made to the following detailed description and accompanying drawings wherein.

Figure 1:
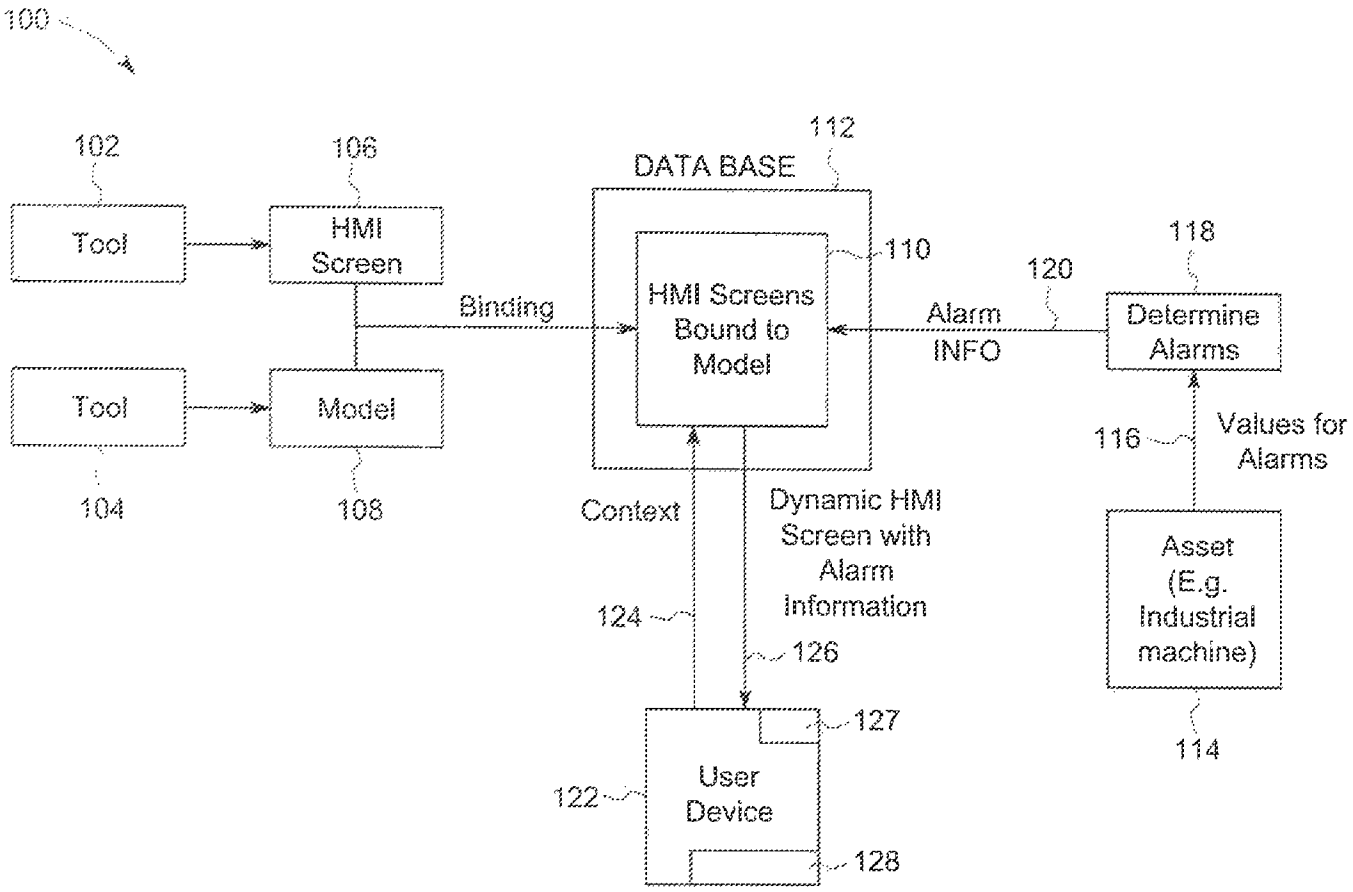
FIG. 1 comprises a block diagram of a system for presenting visualizations to a user according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION OF THE DISCLOSURE

In the present approaches, visualizations that include alarm data are presented to a user on a graphical display unit. The visualizations are dynamic and are context-based. The context used to construct a visualization is determined by user input. It will be appreciated that any other type of information or data such as key performance indicator information, or overall equipment effectiveness information may also be displayed. Other examples are possible.

In the automation industry, plant or factory processes and assets (corresponding to these processes) are related to each other through a model, where the model is a base "container" or data structure that contains the process information along with the associated assets and parameters associated with the assets. The model also determines the relationships that exist between the processes and assets. The model is used to auto-generate a screen by which navigation occurs. For example, a navigation tree can be used by the user to navigate to any process area and/or assets. Based on the context generated by the navigation supplied by the user (e.g., selections made by the user), a HMI screen will be constructed and displayed. The context that is selected by the user may include an area of a plant or factory (including equipment in that area), an entire factory, or a piece of equipment to mention a few examples. All the information and data related to the context will also be dynamically displayed in real-time to the user to provide insight and enable the end user to control and monitor the process area and/or assets.

In the present approaches, a context-based alarm display along with the HMI screen are presented to a user. The user can view the alarm information generated along with its severity based upon (for example) the context of the asset that has generated the alarm.

In some aspects, the user can use a model-driven navigation bar to navigate to any asset or equipment and based on the context, the associated HMI screen, and the live values (e.g., for alarms or other measured parameters), a visualization is loaded into a device where the visualization can be displayed. Every time an alarm is generated on the context where the user has currently navigated, the alarm is displayed as a visual component at the asset (e.g., as an icon near another icon representing the asset, on top of the icon representing the asset, or near the icon representing the component to mention a few examples) that has actually generated the alarm. A list may be maintained somewhere in the system (e.g., at the database or the user device) of active alarms. Once an alarm has been removed from the alarm list, the visual display of the alarm is also removed. The next time the alarm gets generated the alarm again appears in the asset that have produced the alarm.

Using the present approaches, the user can understand the context that may have generated the alarm and visually view this information. In aspects, the severity of the alarm generated is visually presented to the user for faster response and action. Visualizations can be loaded into mobile devices, and it becomes very easy for the user to trace the new alarm generated and tie it to the context of the alarm. Alarm and live value information can be accessed, presented and insights can be inferred with minimal effort.

The user can tag the asset (for which the user wishes to view the alarm) visually during the HMI screen configuration and perform all the steps that they currently follow in creating, for example, Proficy Enterprise Web-based HMI screens. During rendering of the HMI screen, the alarm list is queried to get the list of active alarm for the context and if the asset is tagged, the alarm is visually displayed.

In the present approaches, "context" can be provided by user input. For example, a user's navigation of a model tree (e.g., showing pieces of equipment in a system) and selections from the model tree can also provide the context. In other examples, a navigation bar can be used. In some situations where a process level presentation is desirable, an overview screen may be displayed. A user may "drill down" on the screen (e.g., using a mouse to click on hyperlinks on the screen) to go to other more detailed levels. As the user drills down, views become more detailed with more control properties or diagnostics are presented.

As mentioned, the context selected by the user may be an area of a plant or factory (including equipment in that area), an entire factory, or a piece of equipment to mention a few examples. Other examples are possible. It will also be appreciated that context might also be supplied by sensors (e.g., geolocation of the user).

Referring now to FIG. 1, a system includes a first tool 102, and a second tool 104. The first tool 102 is used to create an HMI screen 106 and the second tool 104 is used to create a model. The HMI screen 106 is bound to the model 108 and foul's an HMI screen or visualization 110 stored at a database 112.

The first tool 102 allows the user to create the HMI screen 106. For example, the user may choose icons, set screen size, set margins, set text size, enter headings, to mention a few examples, in creating the HMI screen 106. The second tool 104 allows a user to create the model 108. For example, the user may create a model such as the model shown in FIG. 2.

The model 108 describes a visualization of one or more graphical displays that can be rendered to a user at the graphical display unit 128 by the processor 127. In the present approaches, the exact visualization associated with the model 108 is customizable and changes over time based upon selections made by the user by navigating through a navigation screen (e.g., including a navigation or model tree). A navigation bar (where the user uses a computer mouse to make a selection) or a keypad are other examples of mechanisms for allowing user entry of context information.

In these regards, the user may navigate through a graphical tree that represents the model 108 and make selections from the tree. In other words, the tree may be a graphical representation as to the content of the model and is rendered to a user at a user interface. In one example, the tree includes fields that list assets (e.g., pumps, valves, or switches). Each of these fields may be a hyperlink and by clicking on the hyperlink, a user can drill down to and access different levels of information. For example, a user clicks on one of these fields (e.g., using a computer mouse or a touch screen) and sees more information relating to the asset or parts of the asset.

The user's selections determine the format and content of the HMI screen or visualization 110 including the alarms displayed. For example, the user may select a first area of the plant and one visualization or screen may be created. The visualization may show icons representing pieces of equipment, connections between this equipment, values of parameters (e.g., pressure or temperature) of the equipment, and alarm icons that are displayed in conjunction with the equipment that generated the alarm. The alarm icons are updated, changed, added, and removed in real-time. Selection of another area of the plant or another piece of equipment may cause another screen to be presented.

The memory (or database) 112 stores HMI screen or visualization 110. The database or memory 112 may be any suitable type of memory, including volatile or non-volatile memories such as random access memory (RAM), dynamic RAM (DRAM), synchronous RAM (SRAM), read-only memory (ROM), programmable ROM (PROM), erasable PROM (EPROM), electrically erasable PROM (EEPROM), non-volatile RAM (NVRAM), flash memory, solid state drives (SSD), embedded Multi-Media Card (eMMC). Other examples are possible.

An asset 114 sends alarm values 116 to a device 118 that determines alarms. The device 108 is any combination of hardware and/or software that monitors the asset for values. In these regards, sensors may be deployed at the asset to monitor and measure parameter values (e.g., temperature, pressure, or flow rate to mention a few examples). These sensed values are transmitted to the device 118. The device 118 may compare these sensed values to thresholds to determine if an alarm should be generated. The device 118 may also examine the absolute values of the measured values, the rate of change of these values, and the direction of movement of these values to determine, for example, the severity of an alarm. The device 118 forms alarm information 120, which may be in a format where it can be added to HMI screen or visualization 110. The device 118 continuously performs these functions so that visualizations presented to user have alarms that are updated dynamically and in real-time.

Alarm information 120 is sent to the database 112. A user device 122 sends a context 124 to the database 112. The database 112 returns a dynamic screen 126 with alarm information 120 within a context determined by the context 124. The screen 126 is rendered at a graphic display unit 128 at the user device 122 by a processor 127.

In aspects, the asset 114 is an industrial machine or system and may be a group of devices or components. Additionally, the asset 114 may include associated software that controls hardware components. In one example, the asset 114 includes pumps, valves, mixers, burners, motors, or any type of machine that is usable to execute an industrial process such as move or controlling the flow of liquid or gases. Other examples are possible. A programmable logic controller (PLC) may be deployed at the asset 114. The PLC may include a microprocessor and may control the operation of some or all of the components of the asset 114. It will be understood that any number of PLCs may be deployed at the asset 114.

In aspects, the alarm icons are displayed within the HMI screen itself. In one example, the icons are displayed in relationship to the area (on the equipment) where the alarm is being generated. In other examples, the alarm icons can be displayed on other graphics. For example, the alarm icons can be displayed on a map.

In one example, one or more industrial machines (asset 114) are selected by a user from a navigation screen on the graphical user interface 127 at the device 122. The selected one or more industrial machines represents a context 124. The database 112 is accessed and a visualization 110 related to the one or more industrial machines (asset 114) and associated with the context 124 is retrieved. Alarm data 120 related to one or more alarms associated with the one or more industrial machines is received. The visualization 110 is dynamically rendered to a user on the graphical display unit 127 such that the alarm data 120 is selectively displayed within the visualization 110 and in a single view to the user.

Figure 2:
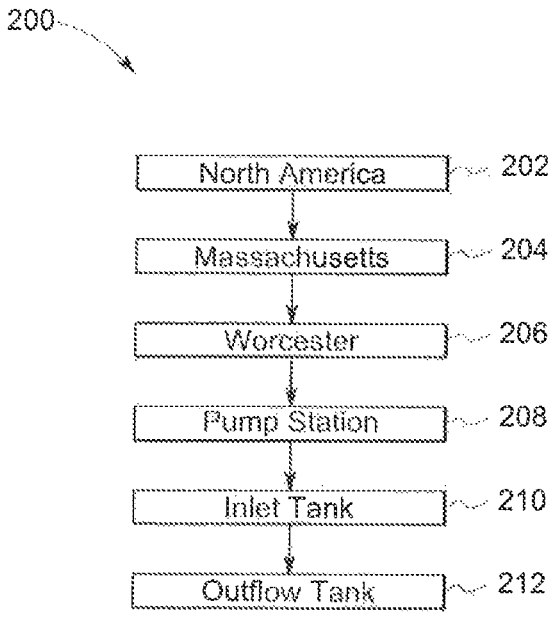
FIG. 2 comprises one example of a model according to various embodiments of the present invention.

Referring now to FIG. 2, one example of a model is shown and is now described. The model has a first row 202, a second row 204, a third row 206, a fourth row 208, a fifth row 210, and a sixth row 212.

The first row 202 includes data that indicates a continent ("North America"). The second row 204 indices a region within the continent ("Massachusetts"). The third row 206 indicates a city within the region ("Worchester"). The fourth row 208 indicates an industrial machine or system ("Pump Station"). The fifth row 210 includes an element within the industrial machine ("inlet tank"). The sixth row 212 includes another element within the industrial machine ("outflow tank"). Other information can be linked or appended to these elements. Together, the model describes or models a pump station. It will be appreciated that this is one example of a model and other examples are possible. Parameters associated with the inlet tank and the outflow tank may also be included.

Figure 3:
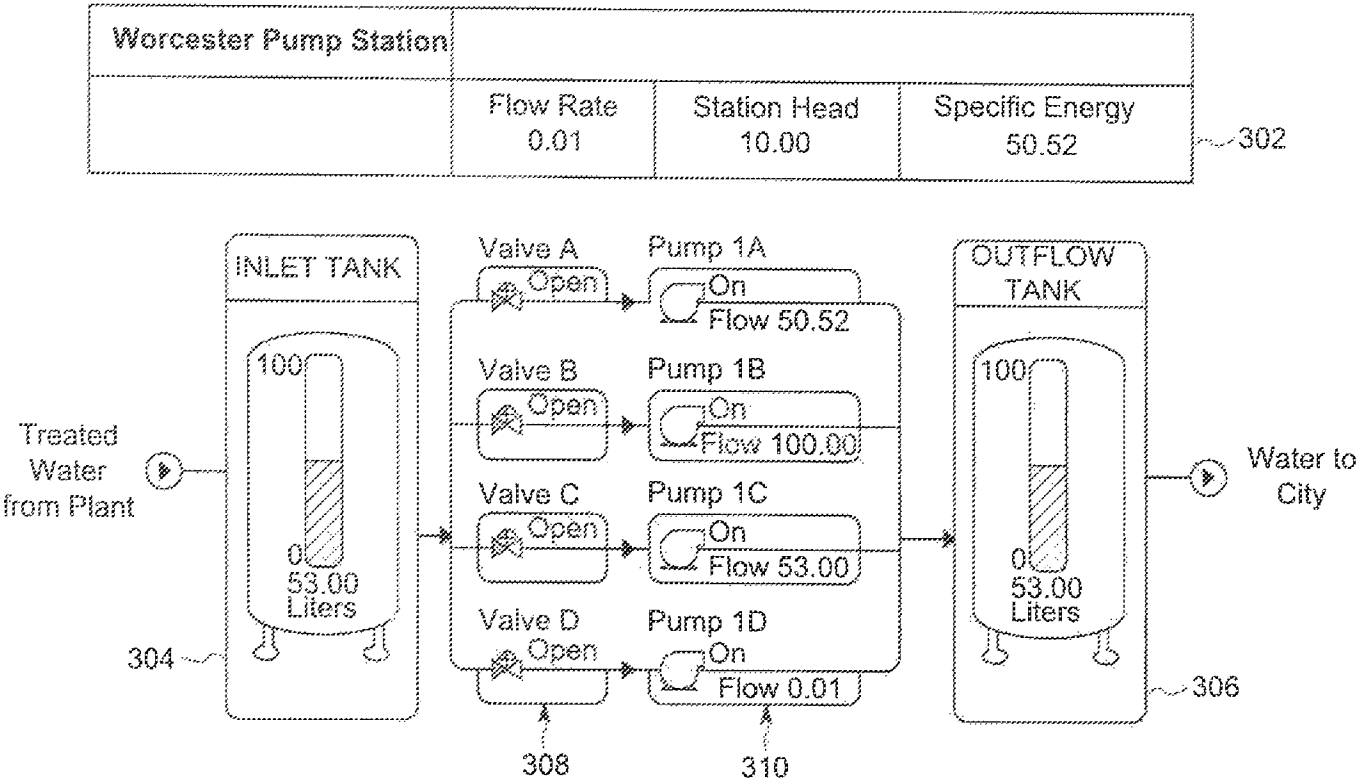
FIG. 3 comprises one example of a HMI screen according to various embodiments of the present invention.

Referring now to FIG. 3, a base visualization (e.g., an HMI screen presented or rendered to a user on a graphical display unit) includes a first field 302, a second field 304, a third field 306, a fourth field 308, and a fifth field 310. In one example, this screen may represent the HMI screen 106 that is bound to the model 108. The base visualization will have alarm data added to it.

The first field 302 shows different parameters of the system (e.g., flow rate). The second field 304 shows the inlet tank and various parameters and characteristics of this component. The third field 306 shows the outflow tank. The fourth field 308 shows various pumps and the fifth field 310 shows various valves. The base visualization of FIG. 3 is bound (linked via computer software) to the model (and the elements in the model) of FIG. 2.

Figure 4:
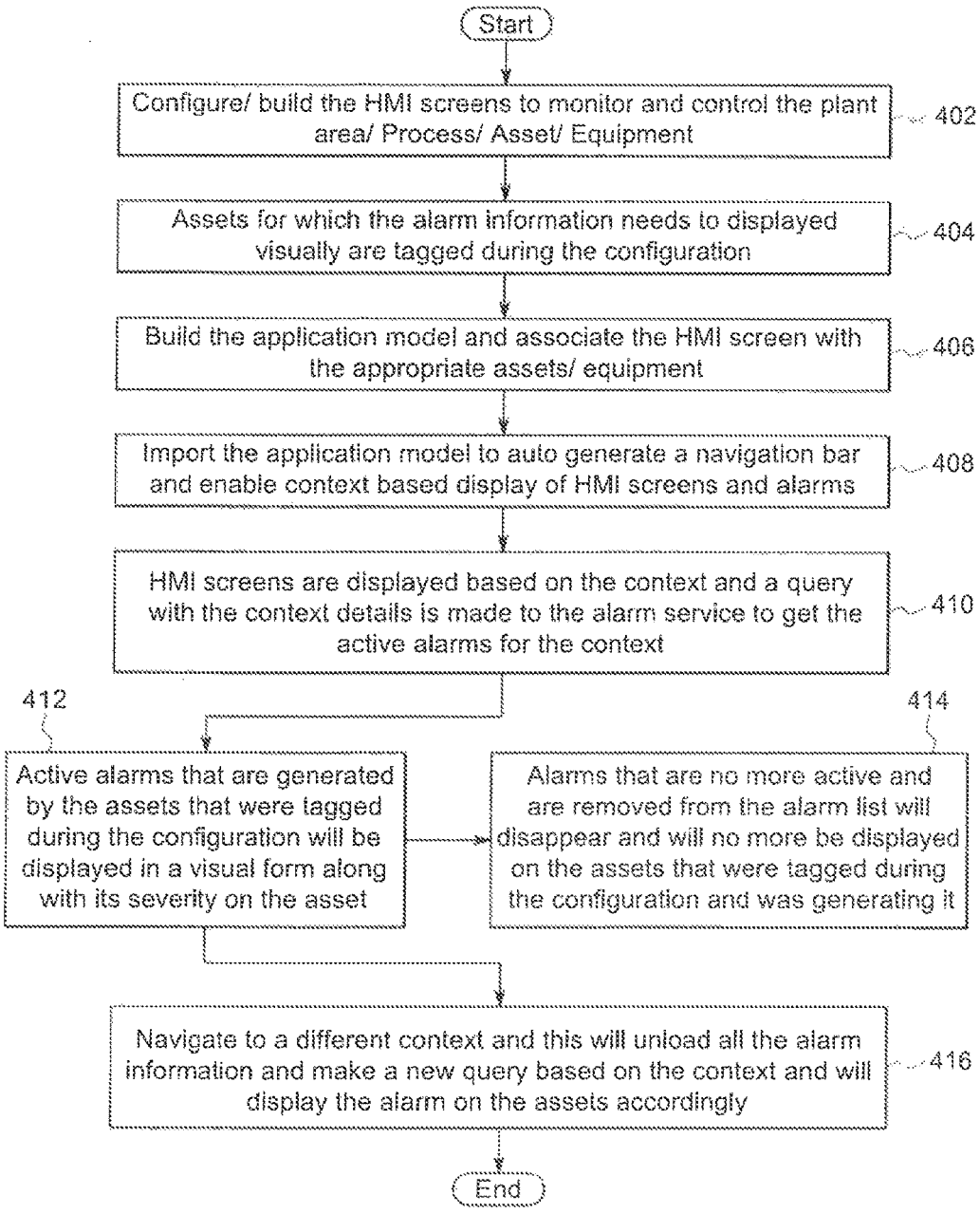
FIG. 4 comprises a flowchart showing an approach for presenting visualizations to a user according to various embodiments of the present invention.

Referring now to FIG. 4, one example of an approach of rendering visualizations to a user is described. In these examples, the HMI screens are used to monitor and control a plant (or factory) area.

At step 402, base HMI screens are configured or built. This may be accomplished by a user utilizing a computer-based tool. For example, the user may select the format of an HMI screen, fonts for alphanumeric displays, icons representing equipment, and fields to display parameters.

At step 404, assets for which the alarm information needs to be displayed may be visually tagged also during the configuration process. This may involve the user, for example, checking check box on the HMI screen during the configuration process. In one example, the user may indicate that a pump is to be monitored for alarm conditions.

At step 406, an application model is built where the HMI screen is associated with (bound) to the model, and thus, to the appropriate assets or equipment. The binding may be accomplished by appropriate computer software.

Next at step 408, the bound application model is imported into a data base (e.g., database 112 of FIG. 1) to auto generate the navigation bar and enable the context-based display of HMI screens and alarms.

At step 410, HMI screens (visualizations) are displayed at a user device (e.g., user device 122 of FIG. 1) based upon the context indicated by user input. An alarm micro-service process (e.g., implemented by computer software) may be used to obtain the active alarms for the context information (e.g., using the device 118 of FIG. 1).

At step 412, active alarms that are generated by the assets and that were tagged during the configuration (at step 404) will be displayed in a visual form to the user on a graphical display unit (e.g., graphical display unit 127 of FIG. 1). In other examples, the severity of the alarm may also be displayed. During configuration, the user may select where an alarm is displayed relative to an asset in a visualization (e.g., next to an icon representing the asset, on top of the icon, or near the icon to mention a few examples).

At step 414, alarms that are no longer active and have been removed from an alarm list maintained at the database (for example) will disappear from the display and are not displayed with the assets.

At step 416, navigation by a user to a different context will unload all the alarm information and make a new visualization based on the context and will display the alarm on the assets accordingly.

Figure 5:
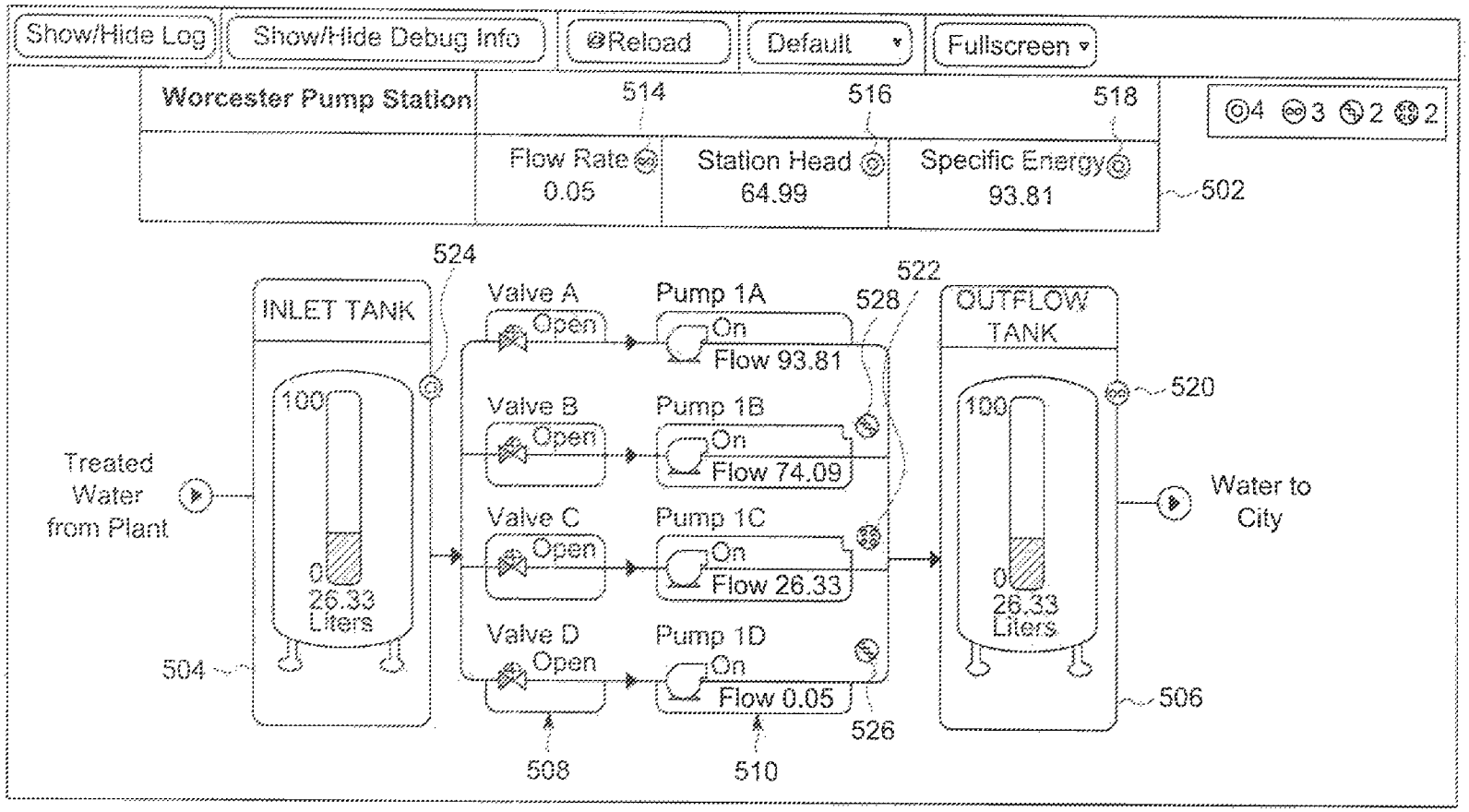
FIG. 5 comprises a visualization including alarm data according to various embodiments of the present invention.

Referring now to FIG. 5, a screen includes a first field 502, a second field 504, a third field 506, a fourth field 508, and a fifth field 510. The first field 502 shows different parameters of the system (e.g., flow rate). The second field 504 shows the inlet tank and various parameters and characteristics of this component. The third field 506 shows the outflow tank. The fourth field 508 shows various pumps and the fifth field 510 shows various valves.

Alarm icons 514, 516, 518, 520, 522, 524, 526, and 528 are also displayed. It will be appreciated that these alarm icons are displayed on the same screen as the other information. Further, the icons are displayed in some cases next to the industrial components (e.g., the inlet tank) that actually generated the alarm. The screen itself is generated according to user input (e.g., the user navigating and making selections from a model tree). The alarms with the highest priority can be highlighted (e.g., by a special color, by flashing, by a different size). Text explaining the alarm can also be displayed. The alarms may be changeable icons displayed next to an icon representing the asset, on top of the icon, or near the icon to mention a few examples. A user may select alarm icon placement during configuration using an appropriate software tool.

Since the alarms are on the same screen or visualization, the user can quickly see what component has issued the alarm, how this component relates to other components, what other components are alarmed, and how overall system performance is affected. The user does not need to manually flip or change between screens. The screen or visualization can be sized to be displayed on the graphical display unit of a mobile device such as a cellular phone, thereby allowing the user to conveniently analyze alarm information and take action while walking through an area where the equipment is disposed.

Figure 6A:
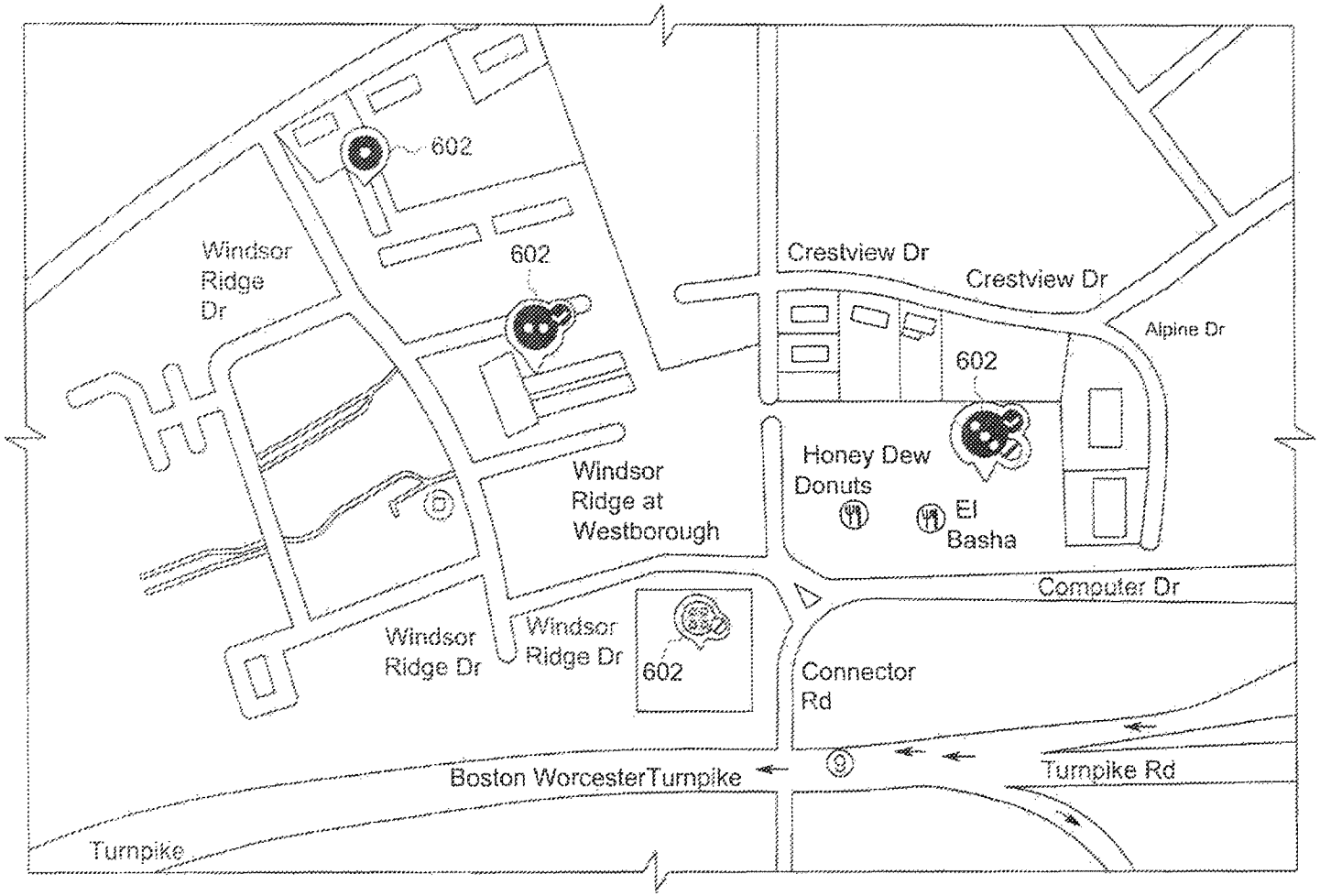
FIGS. 6A-6C show alarms displayed on maps according to various embodiments of the present invention.

As mentioned, alarms can be displayed as alarm icons or "pins" overplayed onto (displayed over) a visual representation of the user's environment. Referring now to FIG. 6A, alarm pins 602 are overplayed over a map of a portion of a city (possibly with other status icons) to indicate a facility status or equipment status over a region. These icons are selectable by a user as described above.

Figure 6B:
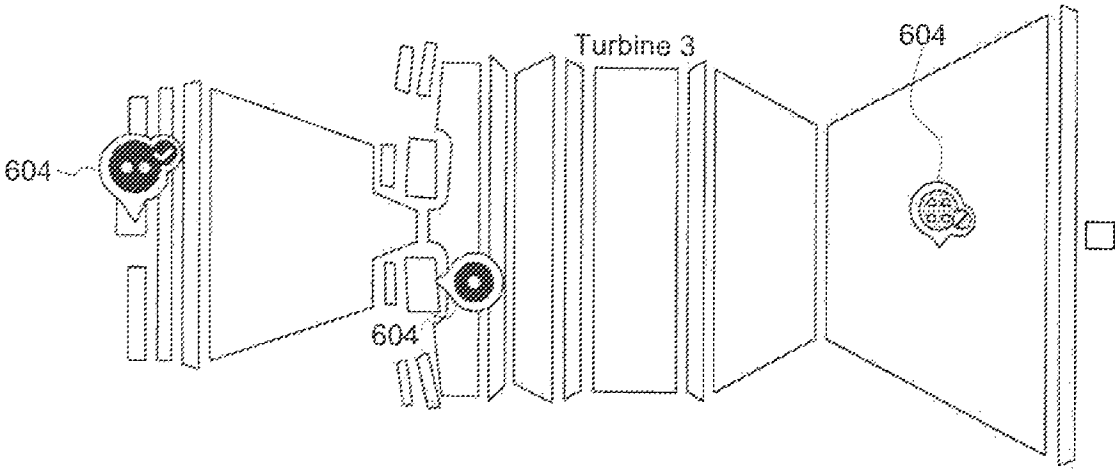
Figure 6C:
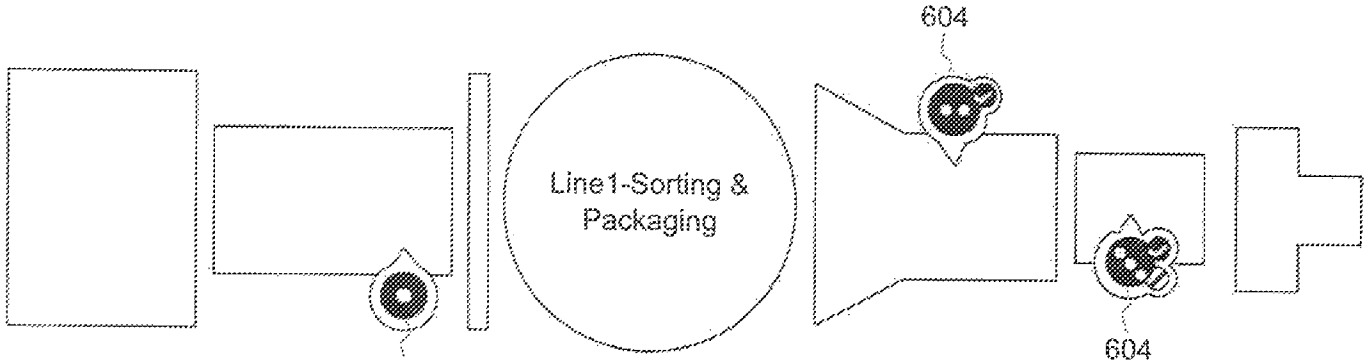

Referring now to FIGS. 6B and 6C, alarms displayed on equipment maps are described. Alarm pins 604 are overplayed (displayed) over a floor plan (with multiple pieces of equipment) or a large piece of equipment (such as a gas turbine) possibly with other status icons. The alarm pins 604 indicate the status of specific elements (or equipment lines/zones) or equipment status within a building or manufacturing facility. These icons are selectable by a user as described above.

Other information besides alarms could also be displayed in this manner. For example, if a user wants to see information concerning different pieces of equipment or which machines are not running optimally, this information could be overlayed in a similar manner. A developer could also choose the contextual "cards" they want representing information for each asset combined with the arrangement of assets based on process flow.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A method, comprising:

electronically tagging selected industrial machines during a configuration process, the tagged industrial machines being assets for which alarm information can be displayed;

auto generating a navigation screen by importing an application model into a database, the application model comprising an HMI screen bound to a model representing a graphical tree;

selecting one or more industrial machines from the navigation screen, the selected one or more industrial machines representing a context;

receiving alarm data related to the tagged alarms and storing the alarm data in the database;

accessing the database and retrieving a visualization and the alarm data related to the one or more industrial machines and associated with the context;

dynamically rendering the visualization to a user on a graphical display unit such that the alarm data is selectively displayed within the visualization and in a single view to the user;

wherein the alarm data is displayed over a visual representation of the user's physical and geographical environment, and wherein the alarm data comprises a first alarm icon for alarm data from a first industrial machine and a second alarm icon for alarm data from a second industrial machine;

wherein the user's physical and geographic environment and the positioning of the first alarm icon and the second alarm icon are depicted in the visualization so as to allow the user to ascertain a geographic relationship between the first industrial machine and the second industrial machine, an operational relationship between the first industrial machine and the second industrial machine, and a relationship between alarms occurring at the first industrial machine and alarms occurring at the second industrial machine.

2. The method of claim 1, dynamically updating the alarm data with new alarm data.

3. The method of claim 1, wherein the geographical relationship is over a plant or factory.

4. The method of claim 1, wherein the selection of the first alarm icon or the second alarm icon is by the user is effective to display text that indicates an action to take.

5. The method of claim 1, further comprising determining the alarm with the highest priority, and graphically highlighting that the icon associated with this alarm.

6. The method of claim 1, wherein the geographical relationship is over a geographic region.

7. The method of claim 1, wherein selecting one or more industrial machines from a navigation screen comprises selecting a machine from a model tree.

8. An apparatus, comprising:

a graphical display unit;

a processor coupled to the graphical display unit;

wherein a user electronically tags selected industrial machines during a configuration process, the tagged industrial machines being assets for which alarm information can be displayed;

wherein the processor auto generates a navigation screen on the graphical display unit by importing an application model into a database, the application model comprising an HMI screen bound to a model representing a graphical tree;

wherein a user selects one or more industrial machines from the navigation screen on the graphical display unit, the selected one or more industrial machines representing a context;

wherein the processor is configured to retrieve from the database a visualization related to the one or more industrial machines and associated with the context, the visualization also including alarm data related to one or more alarms associated with the one or more industrial machines, the alarm data stored in the database, wherein the processor is configured to dynamically render the visualization to the user on the graphical display unit such that the alarm data is selectively displayed within the visualization and in a single view to the user;

wherein the alarm data is displayed over a visual representation of the user's physical and geographical environment, and wherein the alarm data comprises a first alarm icon for alarm data from a first industrial machine and a second alarm icon for alarm data from a second industrial machine;

wherein the user's physical and geographic environment and the positioning of the first alarm icon and the second alarm icon are depicted in the visualization so as to allow the user to ascertain a geographic relationship between the first industrial machine and the second industrial machine, an operational relationship between the first industrial machine and the second industrial machine, and a relationship between alarms occurring at the first industrial machine and alarms occurring at the second industrial machine.

9. The apparatus of claim 8, wherein the alarm data in the visualization is dynamically updated with new alarm data.

10. The apparatus of claim 8, wherein the geographical relationship is over a plant or factory.

11. The apparatus of claim 8, wherein the selection of the first alarm icon or the second alarm icon is by the user is effective to display text that indicates an action to take.

12. The apparatus of claim 8, wherein the processor graphically highlights an icon associated with the alarm with the highest priority.

13. The apparatus of claim 8, wherein the geographical relationship is over a geographic region.

14. The apparatus of claim 8, wherein the navigation screen comprises a model tree.

15. The apparatus of claim 8, wherein the visual representation of the user's physical and geographical environment is a map.

16. The apparatus of claim 15, wherein the map is a geographic map or a map showing individual pieces of equipment.

* * * * *